US010480238B1

(12) United States Patent
La Force

(10) Patent No.: US 10,480,238 B1
(45) Date of Patent: Nov. 19, 2019

(54) DOOR OPERATING APPARATUS WITH ENHANCED DURABILITY

(71) Applicant: Donald James La Force, Rancho Palos Verdes, CA (US)

(72) Inventor: Donald James La Force, Rancho Palos Verdes, CA (US)

( * ) Notice: Subject to any disclaimer, the term of this patent is extended or adjusted under 35 U.S.C. 154(b) by 44 days.

(21) Appl. No.: 15/902,743

(22) Filed: Feb. 22, 2018

Related U.S. Application Data

(60) Provisional application No. 62/462,235, filed on Feb. 22, 2017.

(51) Int. Cl.
*E05F 15/00* (2015.01)
*E05F 15/627* (2015.01)

(52) U.S. Cl.
CPC ..... *E05F 15/627* (2015.01); *E05Y 2201/422* (2013.01); *E05Y 2201/656* (2013.01); *E05Y 2201/71* (2013.01); *E05Y 2400/324* (2013.01); *E05Y 2400/854* (2013.01); *E05Y 2900/132* (2013.01)

(58) Field of Classification Search
CPC ..... E05F 15/627; E05Y 2201/71; E05Y 2201/422; E05Y 2900/132
USPC ..... 49/139, 140, 325, 339, 340, 347
See application file for complete search history.

(56) References Cited

U.S. PATENT DOCUMENTS

| | | | | |
|---|---|---|---|---|
| 4,893,435 | A * | 1/1990 | Shalit | E05F 15/643 49/139 |
| 5,881,497 | A | 3/1999 | Borgardt | |
| 6,176,044 | B1 | 1/2001 | Nixon | |
| 7,316,096 | B2 * | 1/2008 | Houser | E05F 15/63 49/139 |
| 8,109,038 | B2 * | 2/2012 | Houser | E05F 15/63 49/139 |
| 8,365,469 | B2 | 2/2013 | Kowalczyk | |
| 8,407,937 | B2 | 4/2013 | Houser | |
| 8,434,268 | B2 | 5/2013 | Nixon | |
| 8,499,495 | B2 | 8/2013 | Houser | |
| 9,574,389 | B2 * | 2/2017 | Menze | E05F 15/75 |
| 2014/0325911 | A1 * | 11/2014 | Hass | E05F 15/70 49/31 |

* cited by examiner

*Primary Examiner* — Jerry E Redman
(74) *Attorney, Agent, or Firm* — Plager Schack LLP; Mark H. Plager; Eric Liou

(57) ABSTRACT

A door operating apparatus for use with a door pivotably mounted to a door frame permits the door to swing in one of a manual operation and an automatic operation. The apparatus includes a housing, a first rotatable sprocket disposed in the housing and coupled to the door, a second rotatable sprocket disposed in the housing and connected to the first rotatable sprocket by a roller chain, the second sprocket having a top face with a protrusion, a drive assembly disposed in the housing and having a motor operably connected to a drive arm. A force applied to the door permits the first and second sprockets to rotate simultaneously to enable the door to swing open. Activation of the motor allows the drive arm to contact the protrusion and drive the second sprocket, thereby rotating the first and second sprockets simultaneously to enable the door to swing open.

10 Claims, 6 Drawing Sheets

DOOR OPERATING APPARATUS WITH ENHANCED DURABILITY

RELATED APPLICATION

The application claims priority to provisional patent application U.S. Ser. No. 62/462,235 filed on Feb. 22, 2017, the entire contents of which is herein incorporated by reference.

BACKGROUND

The embodiments herein relate generally to pedestrian swing doors commonly used at entryways in commercial buildings.

Electro-mechanical pedestrian door operators function well in opening and closing doors when signaled to do so by virtue of a switch or sensor. However, these pedestrian doors impede the easy operation of the door if a pedestrian opens the door manually without using a switch or sensor. Exemplary automated door operating systems with these limitations are disclosed in U.S. Pat. Nos. 6,176,044 and 8,434,268. The issue with these systems creates the need for a door operating apparatus that has the advantages of an electro-mechanical automatic door operator and a hydraulic manual door closer combined so that the door can be operated in either the automatic or manual modes.

An attempt to address this problem is disclosed in U.S. Pat. No. 8,499,495, which discloses a drive mechanism for a door operator that permits the door to be opened via manual or electro-mechanical operation. However, this drive mechanism requires many complex and precise machined parts, which increases costs and promotes premature component wear and/or failure. Further, this drive mechanism is coupled to the door head, which takes away valuable space surrounding the door frame. Similarly, U.S. Pat. Nos. 8,365,469, 5,881,497 and 8,407,937 disclose alternative door operating systems that comprise complicated components that are subject to wear, frequent maintenance and/or high operating costs.

As such, there is a need in the industry for a door operating apparatus with enhanced reliability and durability that addresses the limitations of the prior art, which permits a pedestrian door to be operated in both automatic and manual modes. There is a further need for the door operating apparatus to be mounted within the floor to enhance aesthetics and minimize obstructions of space surrounding the door.

SUMMARY

A door operating apparatus with enhanced durability for use with a door pivotably mounted to a door frame is provided. The door operating apparatus is configured to permit the door to swing from a closed position to an open position in one of a manual operation and an automatic operation. The door operating apparatus comprises a housing, a first rotatable sprocket disposed in the housing and coupled to the door, a second rotatable sprocket disposed in the housing and operably connected to the first rotatable sprocket by a roller chain, the second sprocket comprising a bottom face and a top face with a protrusion coupled thereto, a drive assembly disposed in the housing and comprising a motor operably connected to a drive arm located proximate the second rotatable sprocket, wherein a force applied to the door in the manual operation of the door operating apparatus permits the first and second rotatable sprockets to rotate simultaneously to enable the door to swing to the open position, wherein activation of the motor in the automatic operation of the door operating apparatus allows the drive arm to engage in pivotal movement to contact the protrusion and drive the second sprocket, thereby permitting the drive arm to rotate the first and second rotatable sprockets simultaneously to enable the door to swing to the open position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

As depicted in FIGS. 1-5, door operating apparatus 10 is operably connected to door 30, which is preferably a pedestrian-type swing door. Door operating apparatus 10 is configured to permit door 30 to be operated in both automatic and manual operation modes.

Figure 1:
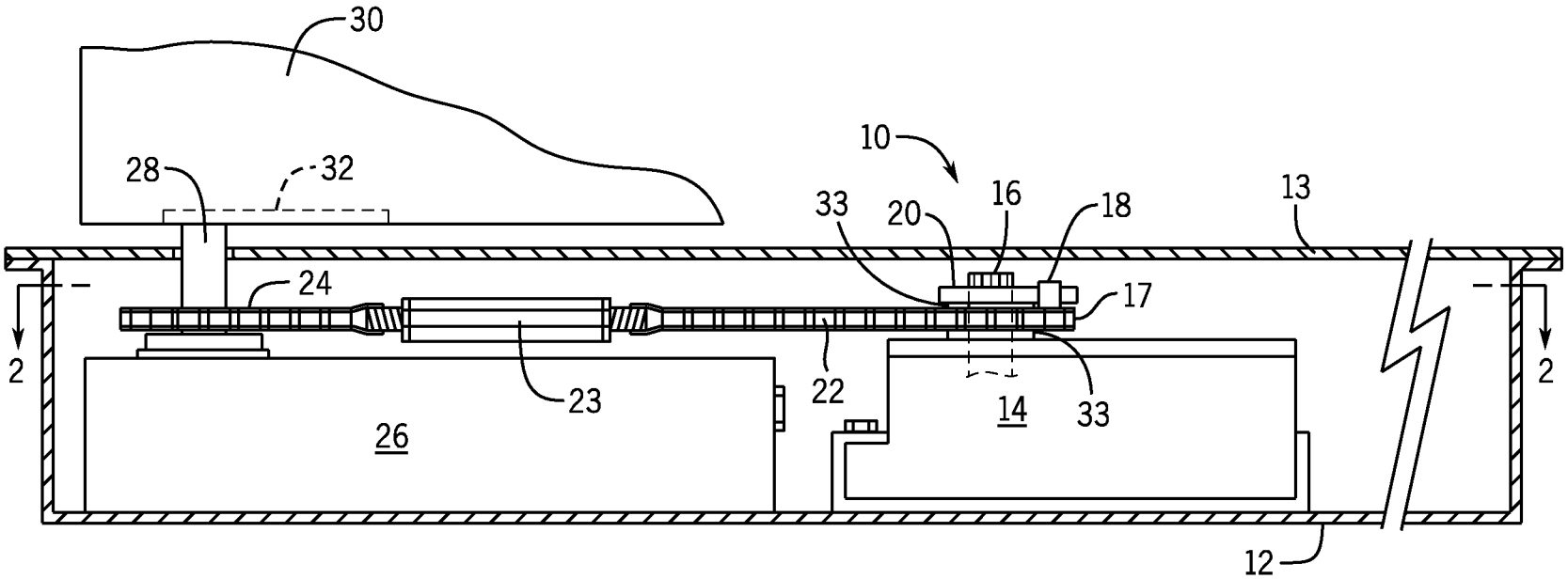
FIG. 1 depicts a side elevation view of certain embodiments of the door operating apparatus.

In certain embodiments, door operating apparatus 10 is preferably mounted within the floor beneath floor plate 13 as depicted in FIG. 1. However, it shall be appreciated that door operating apparatus 10 can be mounted within the ceiling of a building and connected to door 30 in alternative embodiments. Door operating apparatus 10 generally comprises housing 12, motor 14, drive shaft 16, drive sprocket 17, drive arm 20, chain 22, driven sprocket 24, hydraulic manual door closer 26 and driven shaft 28.

In one embodiment, housing 12 is preferably made from steel such as 14 gauge galvanized steel. However, housing 12 may be made from other types of steel, aluminum, alternative metals or other materials. Housing 12 is configured to house motor 14, drive shaft 16, drive sprocket 17, drive arm 20, chain 22, driven sprocket 24, hydraulic manual door closer 26 and driven shaft 28. Driven sprocket 24 is operably connected to bottom door arm 32 of door 30 by driven shaft 28. Driven shaft 28 is connected to hydraulic manual door closer 26. Hydraulic manual door closer 26 is mounted to housing 12 and supported by stand-offs and bosses. Hydraulic manual door closer 26 comprises a hydraulic member configured to drive driven shaft 28 to pivotably adjust door 30 from the open position to the closed position after a predetermined time. Hydraulic manual door closer 26 can be adjusted to vary the predetermined time.

Figure 2:
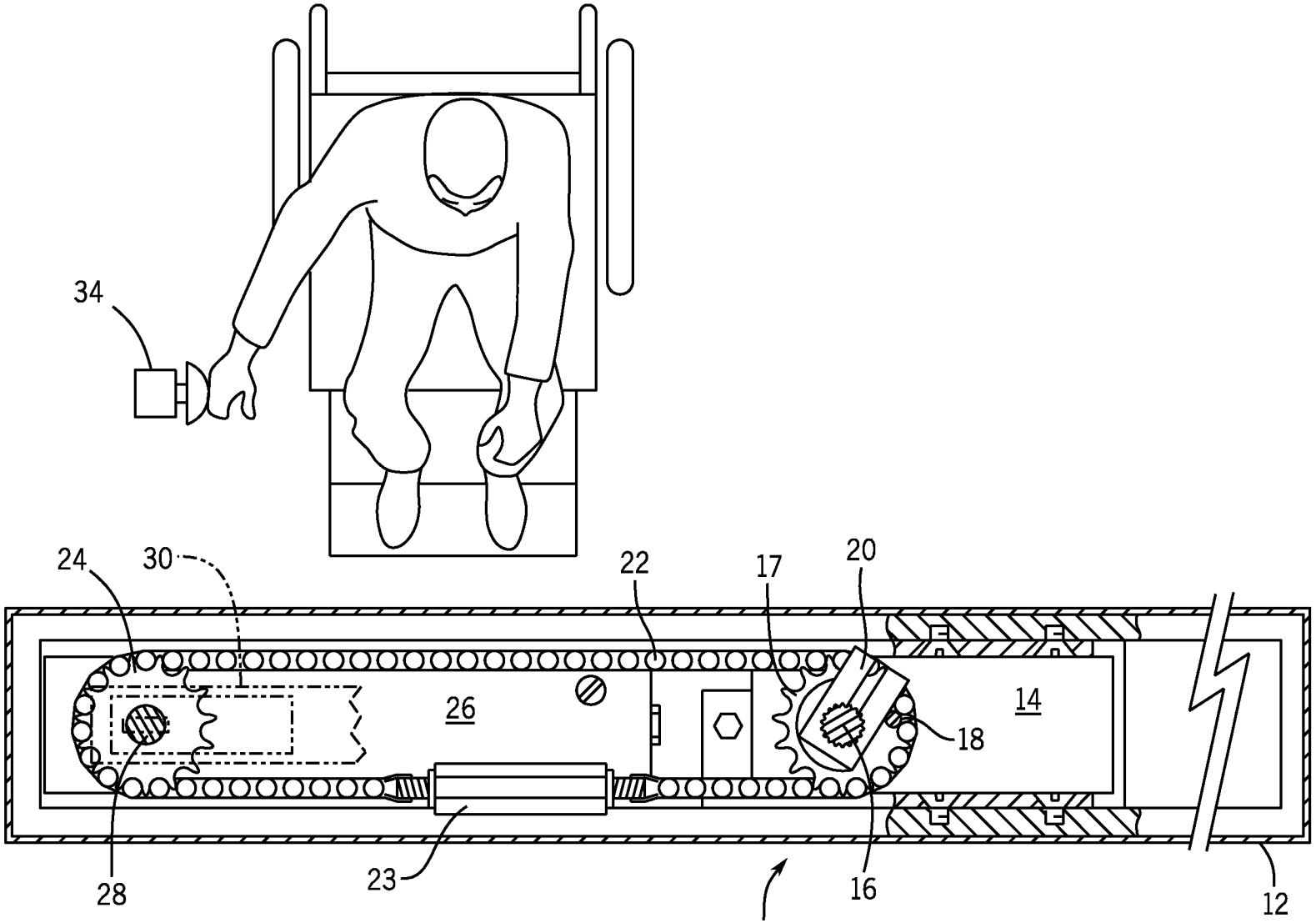
FIG. 2 depicts a section view of certain embodiments of the door operating apparatus taken along line 2-2 in FIG. 1 in an automatic operation with the door in the closed position.
Figure 6:
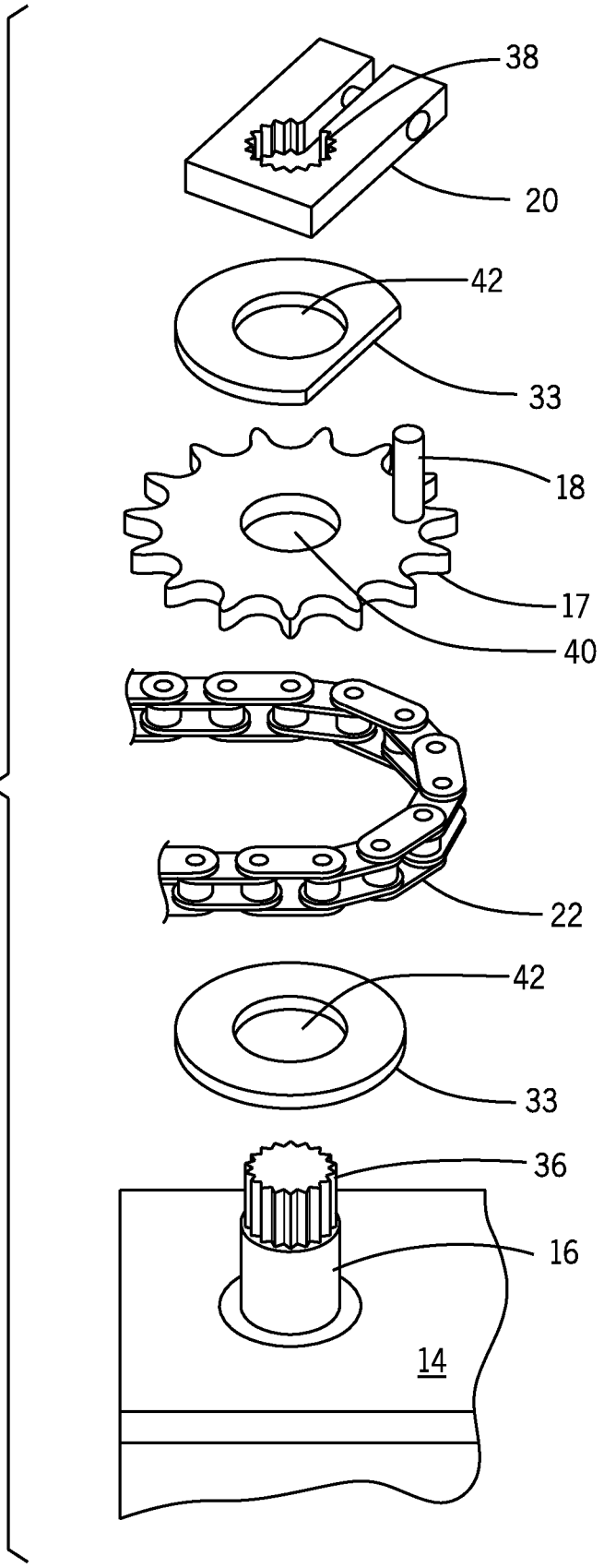
FIG. 6 depicts an exploded view of certain embodiments of the door operating apparatus.

As depicted in FIGS. 1-2 and 6, drive sprocket 17 is operably connected to drive shaft 16 and drive arm 20, which are mechanically coupled to motor 14. Drive sprocket 17 is made from steel and comprises central opening 40 with a diameter of approximately 1". Drive sprocket 17 preferably has 18 teeth with an approximate diameter of 3⅜" from peak to peak of the teeth and approximate diameter of 2¾" from valley to valley between teeth. However, it shall be appreciated that the number of teeth in drive sprocket 17 may vary in alternative embodiments.

Protrusion 18 is preferably a steel cylindrical-shaped member coupled to the top face of drive sprocket 17. Protrusion 18 is preferably screwed to drive sprocket 17 or coupled thereon using an alternative fastening means. In one embodiment, protrusion 18 comprises a diameter of approximately ⅜" and a projecting height of approximately ¾" above drive sprocket 17.

Motor 14 is preferably a DC drive motor rated at ⅛ HP or greater that is operably connected to drive shaft 16. However, it shall be appreciated that the specifications of motor 14 may vary as a function of the door size and weight, and ambient conditions present such as air movement and/or the use of any applicable ancillary door hardware. Drive shaft 16 is rotatably mounted to motor 14 and comprises a diameter of approximately ⅞" and a projecting height of approximately 1½" above the housing of motor 14. A plurality of vertically oriented teeth 36 are disposed around the circumference of drive shaft 16 on the upper portion of the shaft.

Drive sprocket 17 is slipped around drive shaft 16 and placed in between a pair of bearings 33. Each bearing 33 is preferably an oil-infused bearing with an approximate outer diameter of 2" and central opening 42 with an approximate diameter of 1". A first bearing 33, drive sprocket 17 and a second bearing 33 are disposed around drive shaft 16 such that drive shaft 16 extends through central openings 42 of bearings 33 and central opening 40 of drive sprocket 17. In this configuration, the first bearing 33 is in contact with the bottom face of drive sprocket 17 and the second bearing 33 is in contact with the top face of drive sprocket 17. The second bearing 33 comprises a cutaway portion to make room for protrusion 18.

Drive arm 20 is preferably made from steel and comprises an opening with a plurality of vertically oriented teeth 38 configured to engage with teeth 36 of drive shaft 16. Drive arm 20 is disposed on the second bearing 33 when connected to drive shaft 16. Bearings 33 help to facilitate the smooth rotation of drive arm 20 and/or drive sprocket 17 when in an operational mode.

Chain 22 is a roller chain coupled to driven sprocket 24 and drive sprocket 17, and comprises adjustable chain coupling 23. In the assembled configuration, the rotation of sprockets 24, 17 permit the teeth of the sprockets to engage with chain 22. Adjustable chain coupling 23 is configured to adjust the length of chain 22 as needed to sufficiently reach sprockets 24, 17. In one embodiment, chain 22 comprises a first end coupled to a first threaded rod and a second end coupled to a second threaded rod. The threaded rods are coupled to the ends of chain 22 by mechanical fasteners such as attachment pins and cotter pins. In one embodiment, adjustable chain coupling 23 comprises a member rotatably mounted to the first and second threaded rods. More specifically, adjustable chain coupling 23 comprises an internal threaded bore configured to receive the first and second threaded rods on opposing ends. Adjustable chain coupling 23 is rotatably adjusted in a first direction to separate the first and second threaded rods, thereby increasing a total length of chain 22. Adjustable chain coupling 23 is rotatably adjusted in a second direction to compress the first and second threaded rods together, thereby decreasing the total length of chain 22.

In one embodiment, momentary contact switch 34 is operably connected to motor 14 of door operating apparatus 10 to facilitate the automatic operation mode. In one embodiment, momentary contact switch 34 is electrically coupled to motor 14 by wiring. It shall be appreciated that momentary contact switch 34 may be located at different locations including an area remote to door operating apparatus 10.

FIG. 2 depicts door operating apparatus 10 implementing an auto-assist function in an automatic operation with door 30 in the closed position. A user depresses momentary contact switch 34 to activate motor 14 and facilitate door operating apparatus in the automatic operation. In an alternative embodiment, motor 14 can be activated by a motion sensor (not shown) that recognizes motion of the user when approaching door 30.

Figure 3:
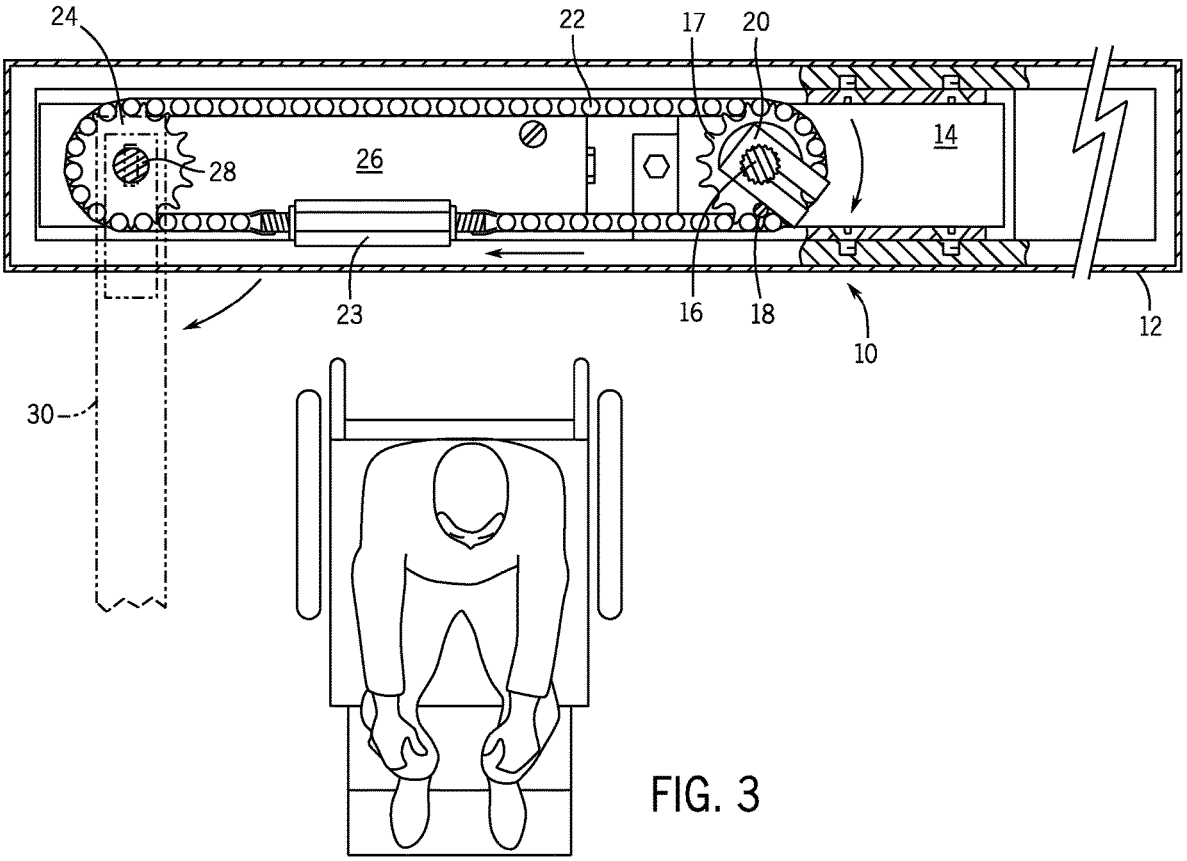
FIG. 3 depicts a section view of certain embodiments of the door operating apparatus in an automatic operation with the door in the open position.

Once activated, motor 14 drives drive shaft 16 approximately up to 90% of a full rotation in a first direction. The rotation of drive shaft 16 rotates drive arm 20 due to the direct connection between the components. The rotating drive arm 20 catches protrusion 18 on drive sprocket 17, which rotates drive sprocket 17. As depicted in FIG. 3, rotation of drive sprocket 17 moves chain 22 to enable driven sprocket 24 to rotate simultaneously. Since driven sprocket 24 is coupled to door 30 by the connection of driven shaft 28 and bottom door arm 32, the rotation of driven sprocket 24 swings door 30 to the open position.

After an adjustable predetermined time delay, momentary contact switch 34 is returned to an open switch position. This permits hydraulic manual door closer 26 to automatically swing door 30 from the open position to the closed position. Specifically, hydraulic manual door closer 26 drives driven shaft 28 in the opposite direction than when door 30 pivots to the open position. This causes driven sprocket 24 to rotate and move chain 22 to rotate drive sprocket 17 simultaneously. During this time, protrusion 18 on drive sprocket 17 catches drive arm 20, which back drives drive shaft 16 of motor 14 as door 30 is returned to the fully closed position. Door operating apparatus 10 is ready to open door 30 in the automatic operation mode as often as needed via momentary contact switch 34.

Figure 4:
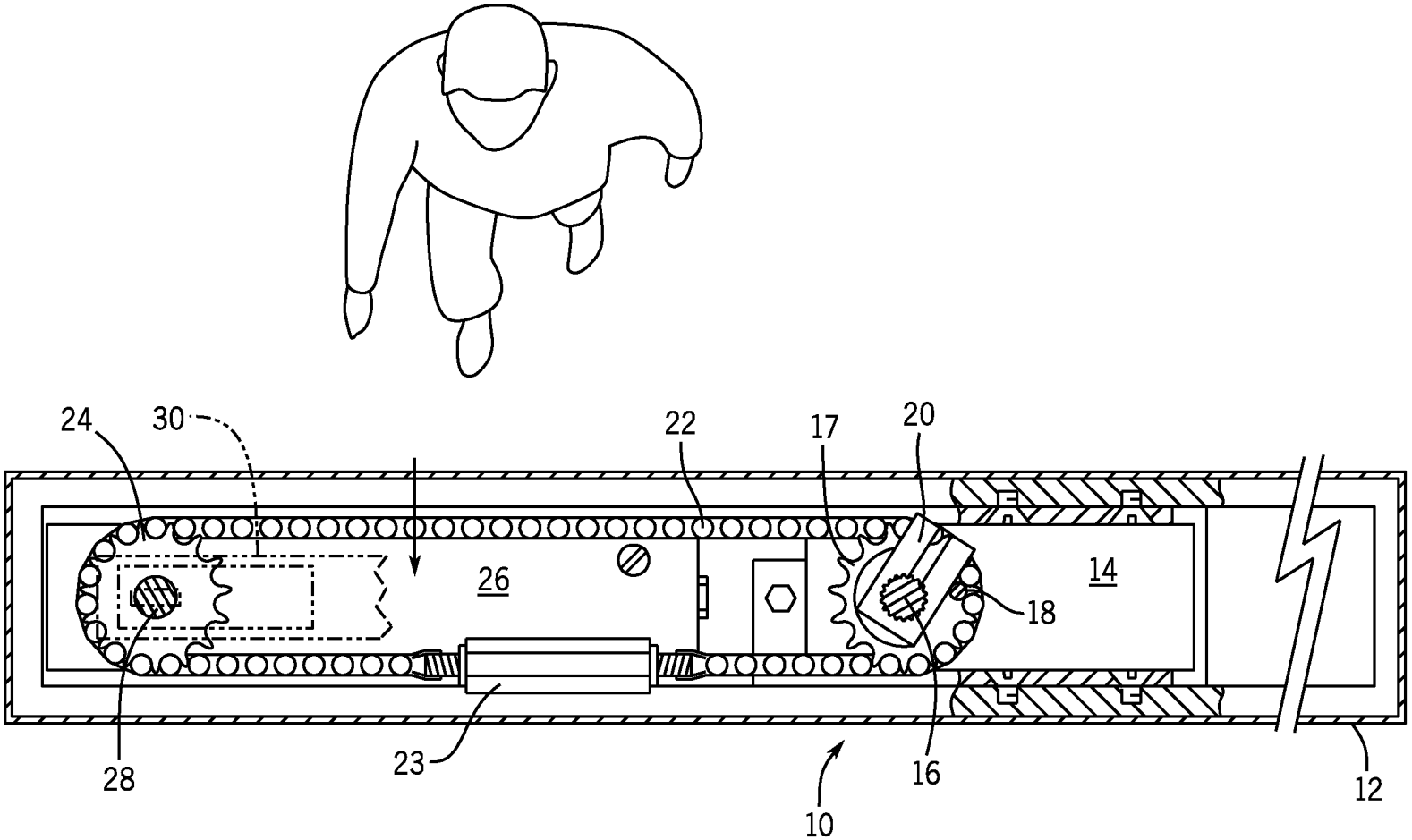
FIG. 4 depicts a section view of certain embodiments of the door operating apparatus in a manual operation with the door in the closed position.
Figure 5:
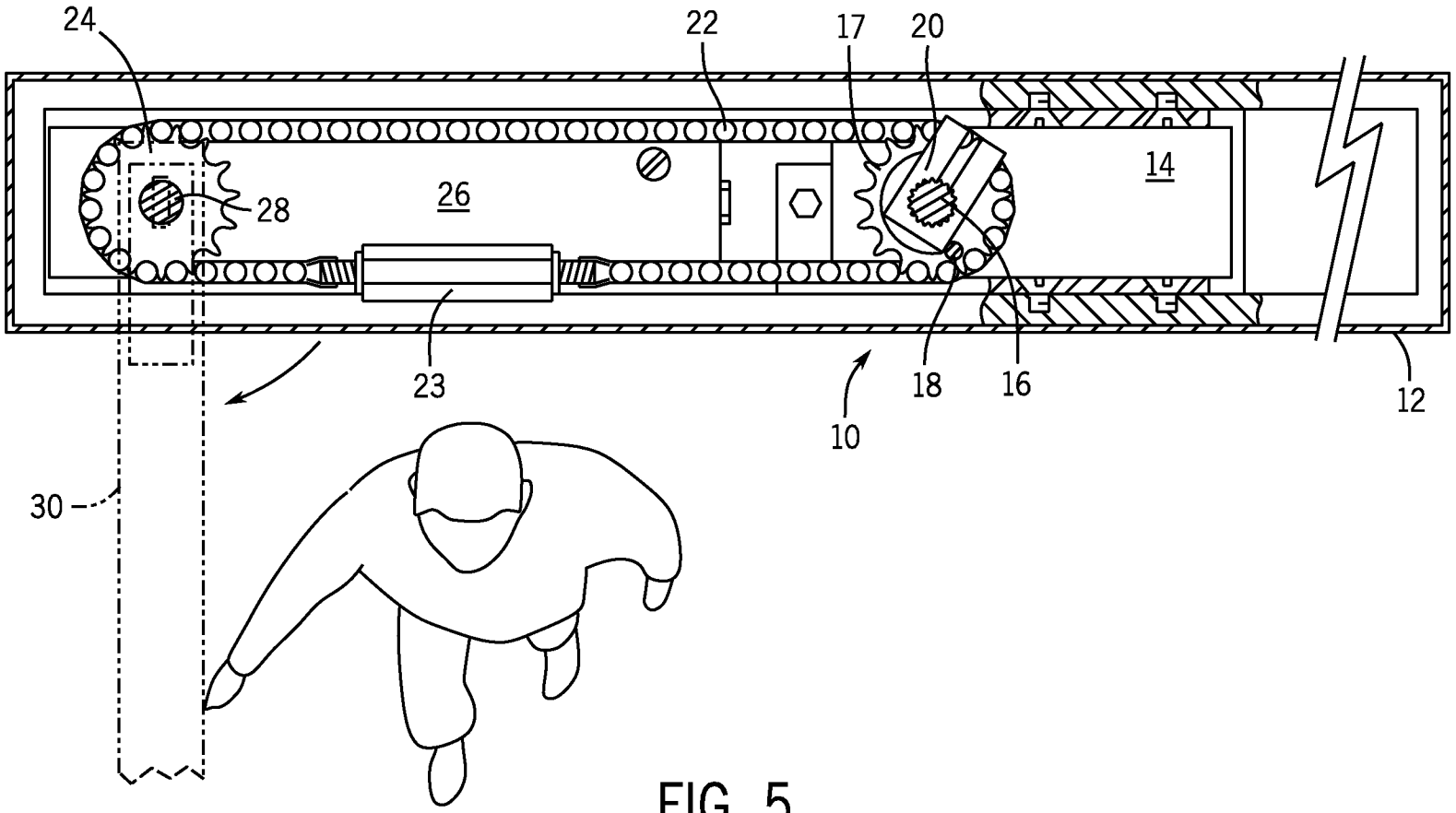
FIG. 5 depicts a section view of certain embodiments of the door operating apparatus in a manual operation with the door in the open position.

In the automatic operation mode, door operating apparatus 10 is configured to permit door 30 to be opened manually at any time. FIG. 4 depicts door operating apparatus 10 ready for use in a manual operation with door 30 in the closed position. During the manual operation mode, the user applies a force on door 30 in the direction of the arrow shown in FIG. 4. As depicted in FIG. 5, the force applied to door 30 swings door 30 to the open position.

The manual operation of door 30 is permitted because drive sprocket 17 is "freewheeling" relative to drive shaft 16 and drive arm 20. As door 30 rotates to the open position, bottom door arm 32 and driven sprocket 24 both rotate the same degree. The rotation of driven sprocket 24 and the associated movement of chain 22 rotates drive sprocket 17, which is free to rotate as it is not attached to drive shaft 16. Notably, drive sprocket 17 is merely slipped over drive shaft 16 and held in place by the housing of motor 14 and drive arm 20. The smooth rotation of drive sprocket 17 is further aided by bearings 33. Since drive sprocket 17 is "freewheeling", drive shaft 16 and drive arm 20 remain stationary during the rotation of door 30 as depicted in FIG. 5.

Once door 30 is released by the user, hydraulic manual door closer 26 returns door 30 from the open position to the closed position as previously described. Door operating apparatus 10 is advantageous because the configuration of its components allows for the manual operation of door 30 to be completely free of any interference from motor 14 and drive arm 20, but still under the control of manual hydraulic door closer 26.

It shall be appreciated that electrical conduit accommodations are provided for power and control circuitry to operate door operating apparatus 10. In alternative embodiments, it shall be appreciated that door operating apparatus 10 may be assembled in different configurations such as attached to the head of door 30. It shall be appreciated that the components of door operating apparatus 10 described in several embodiments herein may comprise any alternative known materials in the field and be of any color, size and/or dimensions. It shall be appreciated that the components of door operating apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A door operating apparatus for use with a door pivotably mounted to a door frame, the door operating apparatus configured to permit the door to swing from a closed position to an open position in one of a manual operation and an automatic operation, the door operating apparatus comprising:

a housing;

a first rotatable sprocket disposed in the housing and coupled to the door;

a second rotatable sprocket disposed in the housing and operably connected to the first rotatable sprocket by a roller chain, the second sprocket comprising a bottom face and a top face with a protrusion coupled thereto;

a drive assembly disposed in the housing and comprising a motor operably connected to a drive arm located proximate the second rotatable sprocket;

wherein a force applied to the door in the manual operation of the door operating apparatus permits the first and second rotatable sprockets to rotate simultaneously to enable the door to swing to the open position, wherein activation of the motor in the automatic operation of the door operating apparatus allows the drive arm to engage in pivotal movement to contact the protrusion and drive the second sprocket, thereby permitting the drive arm to rotate the first and second rotatable sprockets simultaneously to enable the door to swing to the open position.

2. The door operating apparatus of claim 1, wherein the drive assembly comprises a drive shaft operably connected to the motor and extending through a central opening in the second rotatable sprocket, the drive shaft comprising an upper portion with a plurality of teeth configured to engage with a corresponding plurality of teeth in the drive arm.

3. The door operating apparatus of claim 2, further comprising a first bearing disposed around the drive shaft and in contact with the bottom face of the second sprocket and a second bearing disposed around the drive shaft and in contact with both the top face of the second sprocket and the drive arm.

4. The door operating apparatus of claim 3, wherein each bearing in the first and second bearings comprises an oil-infused bearing.

5. The door operating apparatus of claim 4, wherein the protrusion in the second sprocket comprises a generally cylindrical-shaped member.

6. The door operating apparatus of claim 5, further comprising a driven shaft coupled to the door and extending through a central opening in the first sprocket.

7. The door operating apparatus of claim 6, further comprising a hydraulic member disposed in the housing and operably connected to the driven shaft, the hydraulic member configured to activate to drive the driven shaft to swing the door from the open position to the closed position.

8. The door operating apparatus of claim 7 further comprising a switch located remote from the drive assembly and operably connected to the motor, the switch configured to be depressed to activate the motor and facilitate the apparatus in the automatic operation.

9. The door operating apparatus of claim 8, wherein the motor of the drive assembly is rated at least ⅛ horsepower.

10. The door operating apparatus of claim 9, wherein the chain comprises an adjustable coupling member configured to vary length of the chain.

* * * * *